US010069224B2

(12) United States Patent
Lee et al.

(10) Patent No.: US 10,069,224 B2
(45) Date of Patent: Sep. 4, 2018

(54) ELECTRICAL PLUG CONNECTOR AND ELECTRICAL RECEPTACLE CONNECTOR

(71) Applicant: ADVANCED-CONNECTEK INC., New Taipei (TW)

(72) Inventors: Kuo-Ching Lee, New Taipei (TW); Ta-Teh Meng, New Taipei (TW); Cheng-Feng Yu, New Taipei (TW); Wang-Jie Luo, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/786,312

(22) Filed: Oct. 17, 2017

(65) Prior Publication Data

US 2018/0040970 A1 Feb. 8, 2018

Related U.S. Application Data

(62) Division of application No. 15/274,124, filed on Sep. 23, 2016, now Pat. No. 9,831,574.

(30) Foreign Application Priority Data

Sep. 25, 2015 (TW) ..... 104215622 U

(51) Int. Cl.

| | |
|---|---|
| ***H01R 12/70*** | (2011.01) |
| ***H01R 12/73*** | (2011.01) |
| ***H01R 12/71*** | (2011.01) |
| ***H01R 12/57*** | (2011.01) |

(52) U.S. Cl.

CPC ..... *H01R 12/707* (2013.01); *H01R 12/57* (2013.01); *H01R 12/712* (2013.01); *H01R 12/73* (2013.01)

(58) Field of Classification Search

CPC ..... H01R 12/716; H01R 12/57; H01R 12/712
See application file for complete search history.

(56) References Cited

U.S. PATENT DOCUMENTS

| | | | | |
|---|---|---|---|---|
| 7,195,495 | B2 | 3/2007 | Takano et al. | |
| 7,766,666 | B1 * | 8/2010 | Chen | H01R 12/716 439/65 |
| 7,789,673 | B2 * | 9/2010 | Lee | H01R 12/716 439/74 |

(Continued)

*Primary Examiner* — Briggitte R Hammond
(74) *Attorney, Agent, or Firm* — Andrew M. Calderon; Roberts Mlotkowski Safran Cole & Calderon

(57) ABSTRACT

An electrical plug connector includes a plug insulated housing which is integrally formed and plug terminals. A transition segment connected between first and second contact portions of each plug terminal allows the first contact portion to be in contact with and arranged substantially parallel to the second contact portion, so that connectors with reduced width can be manufactured. In addition, the shaping space between a first recessed portion and a second recessed portion of each plug terminal receive materials for forming the plug insulated housing, thus improving the structural strength of the connector. Moreover, embedded ends allow the plug terminals to be secured with the plug bottom wall, so that the plug terminals would not detach from the plug insulated housing easily during manufacturing or operation. The structural strength of the electrical plug connector can be improved, and the plug terminals can be properly assembled with the plug insulated housing.

1 Claim, 11 Drawing Sheets

(56) References Cited

U.S. PATENT DOCUMENTS

| | | | | |
|---|---|---|---|---|
| 8,888,506 | B2 * | 11/2014 | Nishimura | H01R 12/7082 439/74 |
| 2007/0020967 | A1 | 1/2007 | Midorikawa | |
| 2009/0197440 | A1 | 8/2009 | Hirata et al. | |
| 2015/0064942 | A1 | 3/2015 | Takemoto | |
| 2015/0270641 | A1 | 9/2015 | Omodachi et al. | |

* cited by examiner

ELECTRICAL PLUG CONNECTOR AND ELECTRICAL RECEPTACLE CONNECTOR

CROSS-REFERENCE TO RELATED APPLICATION

This application is a Division of application Ser. No. 15/274,124, filed on Sep. 23, 2016, for which priority is claimed under 35 U.S.C. § 120; and this application claims priority of Application No. 104215622 filed in Taiwan, R.O.C. on Sep. 25, 2015 under 35 U.S.C. § 119, the entire contents of all of which are hereby incorporated by reference.

FIELD OF THE INVENTION

The instant disclosure relates to an electrical connector, and more particular to an electrical plug connector and an electrical receptacle connector.

BACKGROUND

It is a trend for 3C products (i.e., computer, communication, and consumer electronics) to be smaller and lighter. In a portable electronic device, different circuit boards would have to be electrically connected with each other, and since the size of the electronic device is quite small, the interior space of the electronic device is small, too. Therefore, board to board connectors (BTB connectors) are adapted to electrically connect between circuit boards to achieve a better usage rate of space.

The BTB connector is a connector assembly. Generally, the connector assembly includes an electrical plug connector and an electrical receptacle connector adapted to be mated with the electrical plug connector. A plurality of male terminals is arranged on the electrical plug connector, and a plurality of female terminals is arranged on the electrical receptacle connector. When the electrical plug connector is inserted into the electrical receptacle connector, the male terminals are mated with the female terminals for the signal connection between two printed circuit boards.

A male terminal of an existing electrical plug connector includes a U shape portion and two contact arms located at two sides of the U shape portion. A soldering leg is extended from one of the contact arms along a direction away from the U shape portion. Since the distance between the contact arms is large, i.e., the contact arms are distant from each other, the size of the electrical receptacle connector has to be larger and so does the circuit board. Therefore, the size of the BTB connector cannot be further reduced.

SUMMARY OF THE INVENTION

Accordingly, in computer apparatuses or electronic devices, since BTB connectors are adapted to electrically connect between two circuit boards. Consequently, how to improve the existing electrical connectors becomes an issue and is diligently developed by the applicant.

In view of this, the instant disclosure provides an electrical plug connector. An embodiment of the electrical plug connector comprises a plug insulated housing and a plurality of plug terminals. The plug insulated housing comprises a plug bottom wall, a pair of first sidewalls, and a pair of first end walls. The pair of first sidewalls is configured to the plug bottom wall along a longitudinal direction. The pair of first end walls is configured to the plug bottom wall along a transversal direction. The pair of first sidewalls and the pair of first end walls define a first connecting space. Each of the plug terminals comprises a first contact portion, a second contact portion, and a first soldering portion. The first contact portion is located in the first connecting space and abutted against one of two surfaces of the corresponding first sidewall. A first recessed portion is formed at the inner lateral surface of the first contact portion, and the width of the portion of the first contact portion having the first recessed portion is less than the width of rest of the first contact portion. The second contact portion is located at the other surface of the corresponding first sidewall and aligned parallel to the first contact portion. One end of the second contact portion is extended to one of two ends of the first contact portion through a transition segment. A second recessed portion is formed at the inner lateral surface of the second contact portion, and the width of the portion of the second contact portion having the second recessed portion is less than the width of rest of the second contact portion. A shaping space is defined between the first recessed portion and the second recessed portion. The first soldering portion is extended outward from the other end of the first contact portion and protruded from the plug bottom wall.

In some embodiments, each of the plug terminals comprises an embedded end formed at the other end of the second contact portion and embedded in the plug bottom wall. In addition, each of the plug terminals comprises a curved segment connected between the first contact portion and the first soldering portion, and the embedded end is extended toward the curved segment and adjacent to the curved segment. The width of the portion of the first contact portion having the first recessed portion is less than the width of the curved segment. The width of the portion of the second contact portion having the second recessed portion is less than the width of the curved segment. Moreover, each of the plug terminals comprises a hook portion formed at an inner lateral surface of the other end of the second contact portion, and the hook portion comprises a protruded block protruded toward the inner lateral surface of the first contact portion.

The instant disclosure also provides an electrical receptacle connector adapted to be mated with the aforementioned electrical plug connector. An embodiment of the electrical receptacle connector comprises a receptacle insulated housing and a plurality of receptacle terminals. The receptacle insulated housing comprises a receptacle bottom wall, a pair of second sidewalls, and a pair of second end walls. The pair of second sidewalls is configured to the receptacle bottom wall along a longitudinal direction. The pair of second end walls is configured to the receptacle bottom wall along a transversal direction. The pair of second sidewalls and the pair of second end walls define a second connecting space. The receptacle bottom wall comprises a tongue portion extended toward the second connecting space. Inner walls of the pair of second sidewalls and two sides of the tongue portion have a plurality of terminal grooves respectively arranged along the longitudinal direction. The terminal grooves are defined through the receptacle bottom wall and communicates with the second connecting space. The pair of second sidewalls comprises a plurality of fixing grooves. The fixing grooves are defined through the respective second sidewalls and correspond to the respective terminal grooves. Each of the receptacle terminals comprises a main arm, a pair of flexible arms, a fixing arm, and a second soldering portion. The main arm is disposed in the receptacle bottom wall. The pair of flexible arms is outward extended from one of two ends of the main arm toward the terminal groove. The fixing arm is outward extended from the other end of the main arm into the corresponding fixing groove. The second soldering portion comprises a bent portion and a contact leg. The bent leg is extended from the other end of the main arm and further extended toward the contact leg. The bottom surface of the main arm is higher than the bottom surface of the contact leg.

In some embodiments, each of the receptacle terminals further comprises a convection groove recessed at the bottom of the main arm to define an air convection area. In addition, each of the receptacle terminals further comprises an engaging block protruded from a side portion of the fixing arm and engaged in an inner lateral surface of the fixing groove. Moreover, the receptacle insulated housing further comprises a plurality of buckling holes respectively defined at the pair of second end walls. The electrical receptacle connector further comprises a plurality of hold down members each comprising an engaging piece and a contact piece. The engaging piece is extended from one end of the corresponding engaging piece and extended out of the receptacle bottom wall.

Based on the above, the transition segment connected between the first contact portion and the second contact portion allows the first contact portion and the second contact portion to be in contact with each other and arranged substantially parallel, so that connectors with reduced width can be manufactured. Accordingly, the electrical plug connector of embodiments of the instant disclosure can be adapted to high precision products, e.g., smart watches. In addition, since the first contact portion and the second contact portion of each of the plug terminals are in contact with each other which reduce the overall width of the connector, and the shaping space between the first recessed portion and the second recessed portion is provided to receive materials for forming the plug insulated housing, the structural strength of the connector can be improved. When the electrical plug connector is mated with the electrical receptacle connector, the plug terminals would not deform easily, and the deformation of the connector caused by heat can be reduced. Moreover, the embedded ends are provided to allow the plug terminals to be secured with the plug bottom wall, the plug terminals would not detach from the plug insulated housing easily during insert-molding procedures or when the electrical plug connector is detached from or assembled to an electrical receptacle connector. Accordingly, the structural strength of the electrical plug connector can be improved, and the plug terminals can be properly assembled with the plug insulated housing.

Detailed description of the characteristics and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
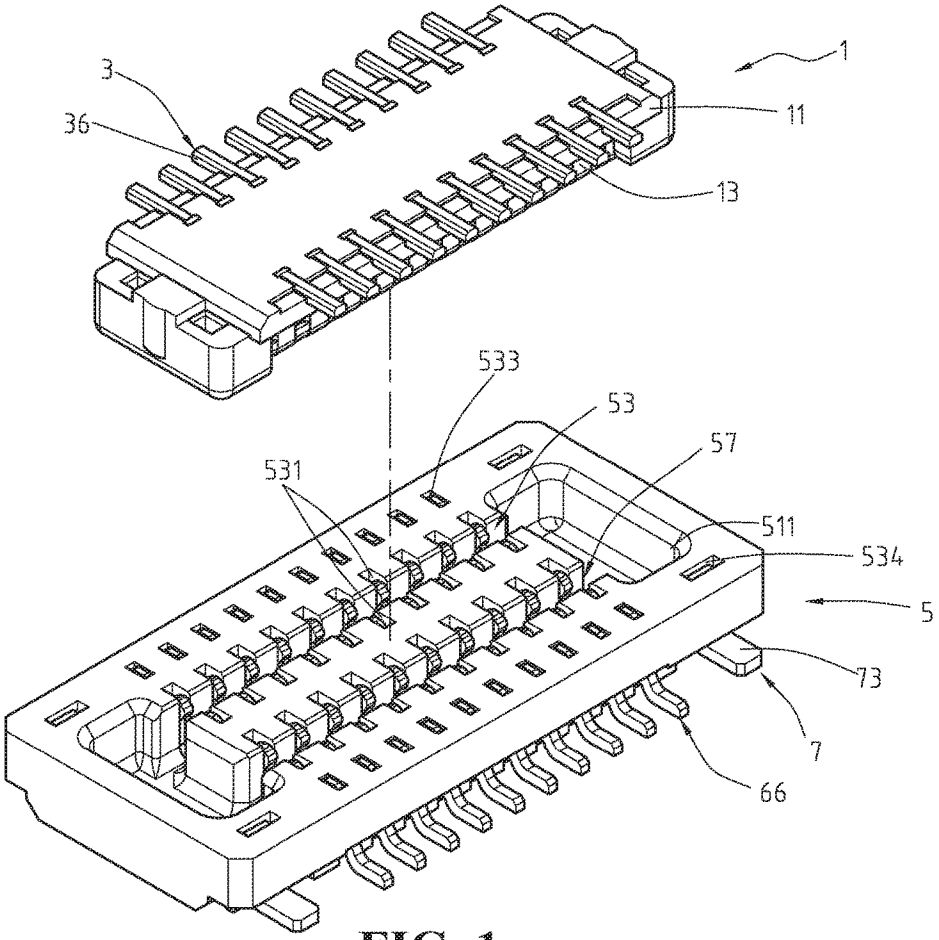
FIG. 1 illustrates an exploded view (1) of an electrical connector assembly according to an exemplary embodiment of the instant disclosure.
Figure 3:
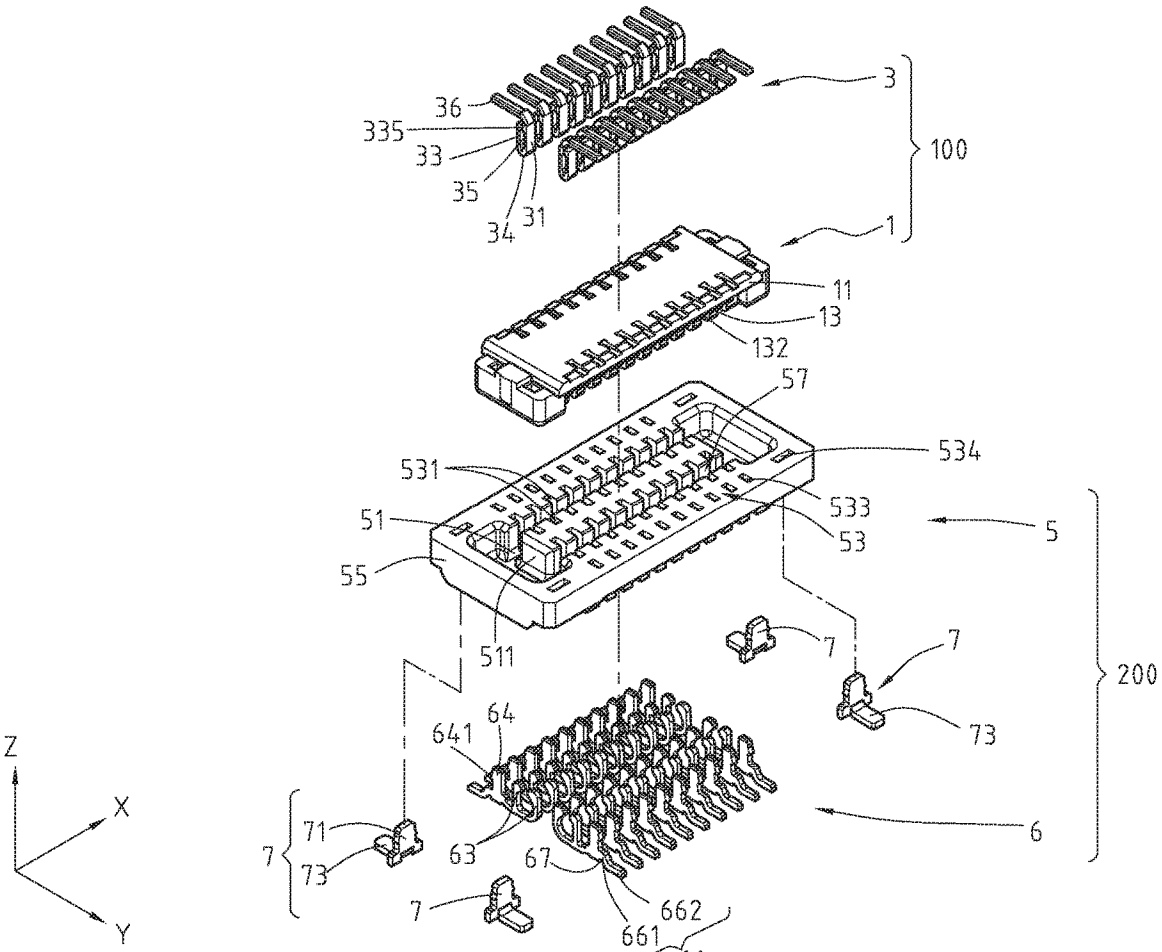
FIG. 3 illustrates an exploded view (2) of the electrical connector assembly.
Figure 5:
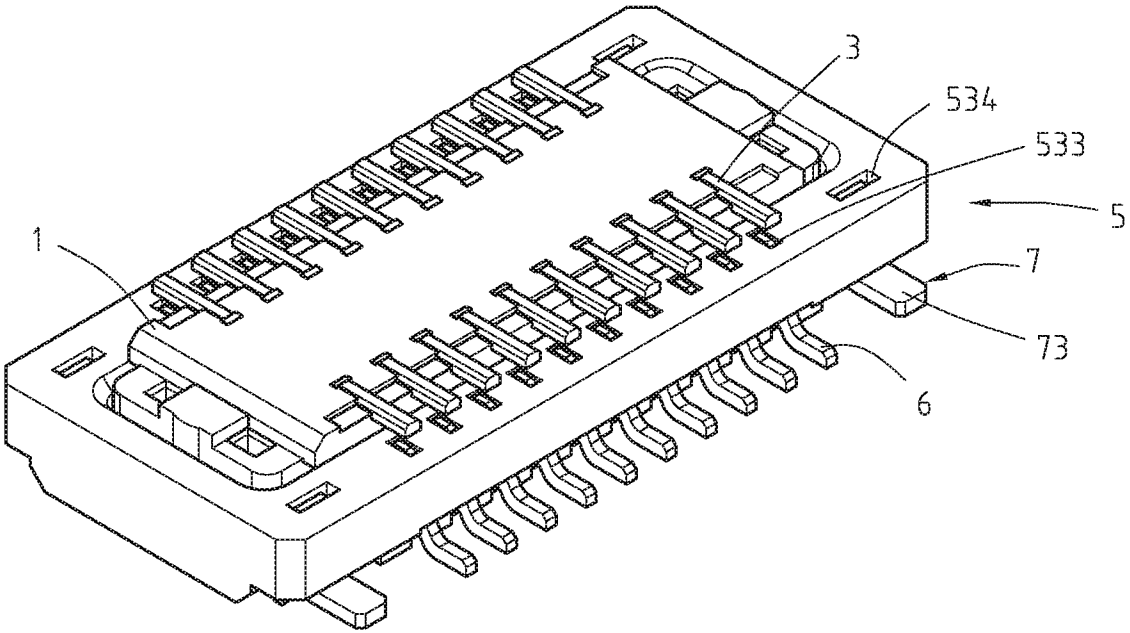
FIG. 5 illustrates a perspective view of the electrical connector assembly.
Figure 6:
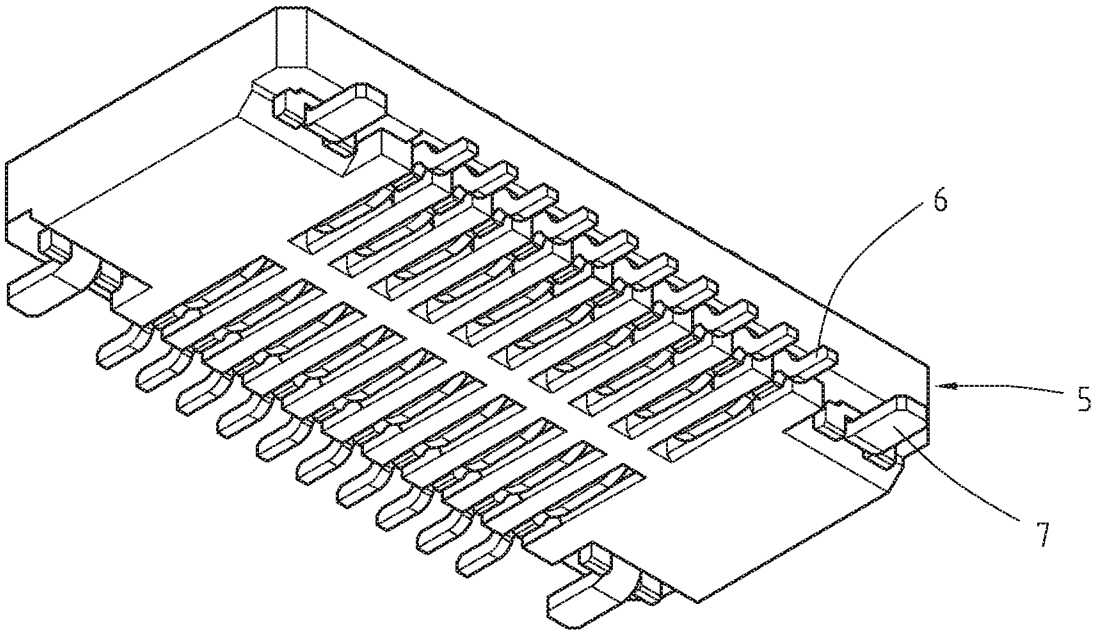
FIG. 6 illustrates another perspective view of the electrical connector assembly.

Please refer to FIG. 1, FIG. 3, and FIG. 5, which illustrate an electrical connector assembly of an exemplary embodiment according to the instant disclosure. FIG. 1 and FIG. 3 illustrate exploded views of the electrical connector assembly, and FIG. 3 illustrates a perspective view of the electrical connector assembly. The electrical connector assembly according to the embodiment comprises an electrical plug connector 100 and an electrical receptacle connector 200 adapted to be mated with the electrical plug connector 100. The electrical connector assembly belongs to board to board connectors (BTB connectors).

Figure 2:
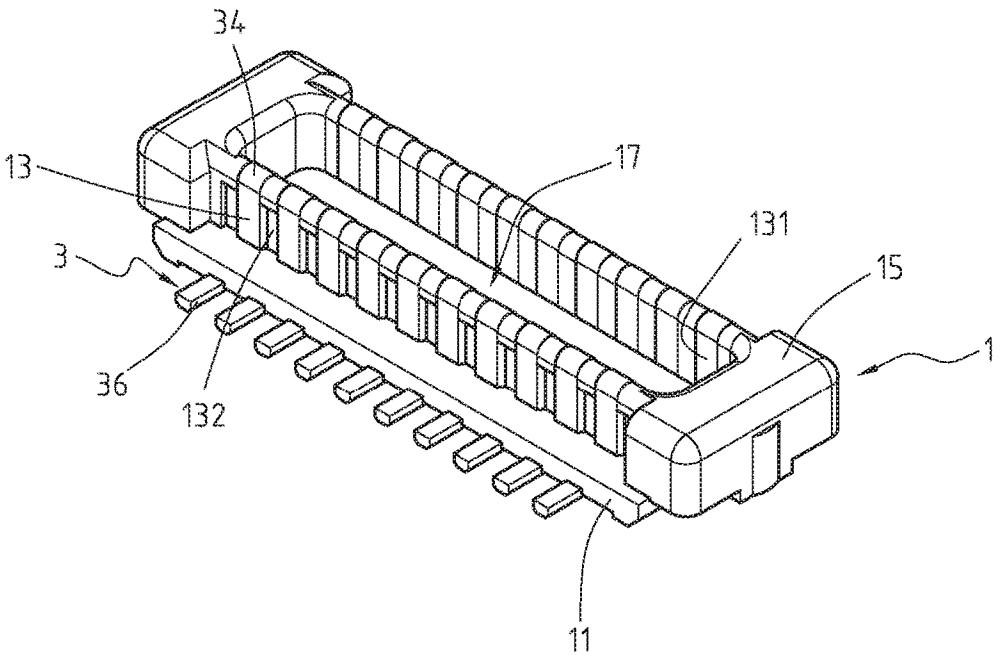
FIG. 2 illustrates a perspective view of an electrical plug connector of the electrical connector assembly.
Figure 4:
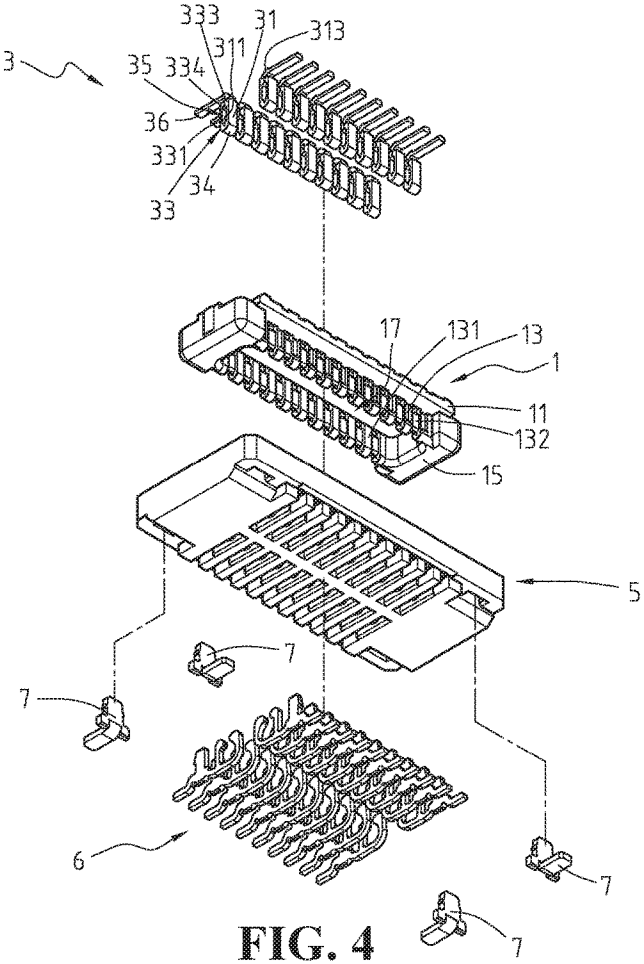
FIG. 4 illustrates an exploded view (3) of the electrical connector assembly.

Please refer to FIG. 2 and FIG. 4, which illustrate an embodiment of the electrical plug connector 100. FIG. 2 illustrates a perspective view of the electrical plug connector 100, and FIG. 4 illustrates an exploded view of the electrical plug connector 100. The electrical plug connector 100 comprises a plug insulated housing 1 and a plurality of plug terminals 3. The plug insulated housing 1 is an elongated member made of plastics. The plug insulated housing 1 comprises a plug bottom wall 11, a pair of first sidewalls 13, and a pair of first end walls 15. The first sidewalls 13 are opposite to and parallel with each other. The first end walls 15 are opposite to and parallel with each other. Specifically, the pair of first sidewalls 13 is configured to the plug bottom wall 11 along a longitudinal direction X, and the pair of first end walls 15 is configured to the plug bottom wall 11 along a transversal direction Y. The pair of first sidewalls 13 and the pair of first end walls 15 are enclosed to define a first connecting space 17.

Please refer to FIG. 3, FIG. 4, and FIGS. 7 to 9. The plug terminals 3 are located at the plug insulated housing 1 and arranged into two parallel lines. Each of the plug terminals 3 comprises a first contact portion 31, a second contact portion 33, and a first soldering portion 36. The first contact portion 31, the second contact portion 33, and the first soldering portion 36 are integrally formed as a whole. The first contact portion 31 is located in the first connecting space 17 and abutted against one of two surfaces (the inner lateral surface 131 or the outer lateral surface 132) of one of the first sidewalls 13. A first recessed portion 311 is formed at the inner lateral surface of the first contact portion 31, and the width of the portion of the first contact portion 31 having the first recessed portion 311 is less than the width of rest of the first contact portion 31, i.e., the width of the first recessed portion 311 is less than the width of other portions of the first contact portion 31. In this embodiment, each of the plug terminals 3 comprises a hook portion 334 formed at an inner lateral surface of the other end of the second contact portion 33. The hook portion 334 comprises a protruded block 335 protruded toward the inner lateral surface of the first contact portion 31. Accordingly, the protruded block 335 improves the structural strength of the second contact portion 33.

Figure 7:
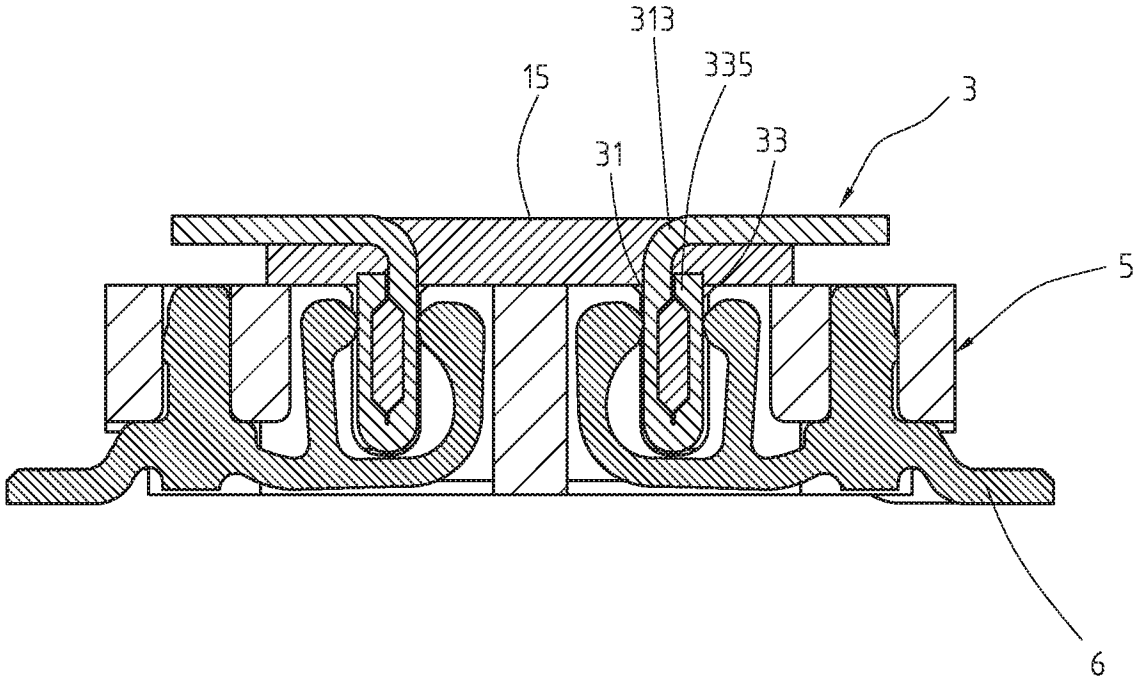
FIG. 7 illustrates a side sectional view of the electrical connector assembly.
Figure 8:
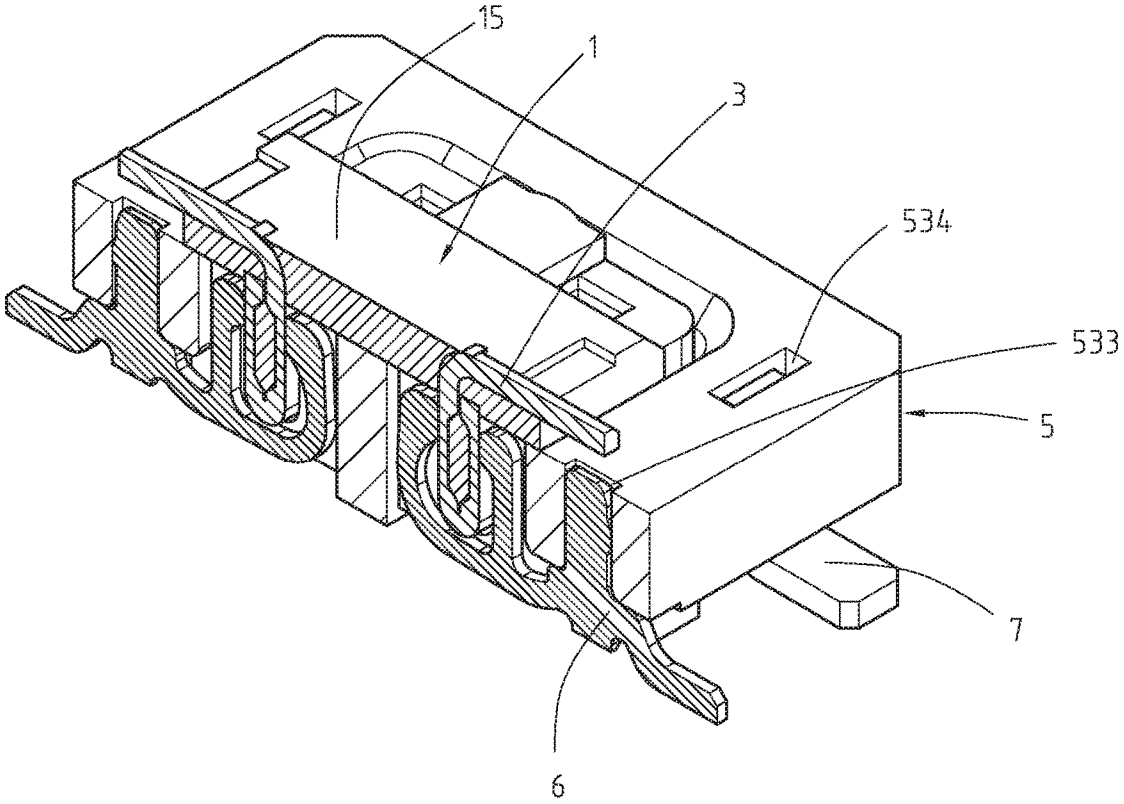
FIG. 8 illustrates a perspective sectional view of the electrical connector assembly.
Figure 9:
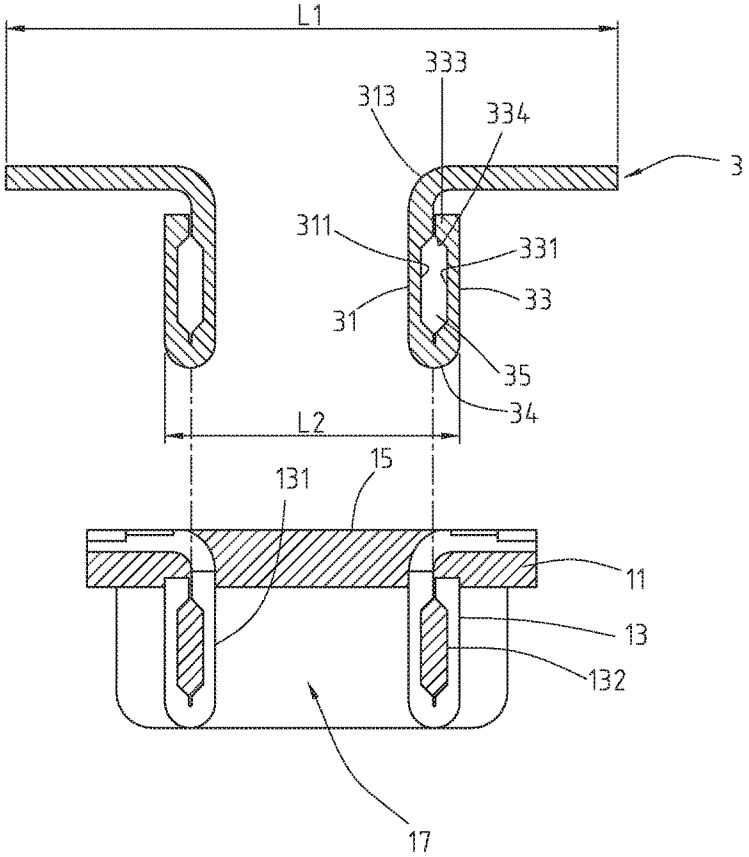
FIG. 9 illustrates a side sectional view of the electrical plug connector of the electrical connector assembly.

Please refer to FIGS. 7 to 9. A transition segment 34 is connected between the first contact portion 31 and the second contact portion 33 of the electrical plug connector 3 to allow the first contact portion 31 and the second contact portion 33 to be arranged substantially parallel. The first contact portion 31 is in contact with the second contact portion 33, so that the width of the electrical plug connector 100 can be reduced. Accordingly, the electrical plug connector 100 which are made in accordance with the embodiments of the instant disclosure can be smaller than an existing BTB plug connector. For instance, for the electrical plug connector 100 having plug terminals 3 of 0.4 mm pitch and 1.0 mm mating height, the distance L1 between two first soldering portions 36 of adjacent plug terminals 3 is 2.53 mm, which is smaller than the distance, 2.74 mm, between two first soldering portions of adjacent male terminals of an existing electrical plug connector. In addition, for the plug terminal 3, the distance L2 between two second contact portions 33 of adjacent plug terminals 3 is 1.22 mm, which is smaller than the distance, 1.54 mm, between two second contact portions of adjacent male terminals of the existing electrical plug connector. Therefore, the overall width of the electrical plug connector 100 according to embodiments of the instant disclosure is less than that of the existing electrical plug connector. Accordingly, space of the circuit boards for assembling with the connector can be also reduced. Consequently, the electrical plug connector 100 of the embodiments of the instant disclosure can be adapted to small sized BTB connectors. Hence, the electrical plug connector 100 can be adapted to high precision products.

Please refer to FIG. 3, FIG. 4, and FIGS. 7 to 9. The second contact portion 33 is located at the other surface (the inner lateral surface 131 or the outer lateral surface 132) of one of the first sidewalls 13. One end of the second contact portion 33 is extended to one of two ends of the first contact portion 31 through the transition segment 34. In other words, the second contact portion 33 is extended from the first contact portion 31 through the transition segment 34, and the first contact portion 31 is substantially parallel to the second contact portion 33. The transition segment 34 is a U-shaped structure which facilitates the assembling and disassembling between the electrical plug connector 100 and the electrical receptacle connector 200. Because of the transition segment 34, the plug terminals 3 would not be damaged easily even when the electrical plug connector 100 is inserted into the electrical receptacle connector 200 by an overexerted force. In addition, a second recessed portion 331 is formed at the inner lateral surface of the second contact portion 33, and the width of the portion of the second contact portion 33 having the second recessed portion 331 is less than the width of rest of the second contact portion 33, i.e., the width of the second recessed portion 331 is less than the width of other portions of the second contact portion 33. Moreover, a shaping space 35 is defined between the first recessed portion 311 and the second recessed portion 331. The shaping space 35 is provided for receiving plastics which is for forming the first sidewalls 13. After the plastics in the shaping space 35 are set, the structural strength of the plug terminals 3 can be improved. Therefore, the plug terminals 3 can be prevented from being deformed when the electrical plug connector 100 is mated with the electrical receptacle connector 200.

Please refer to FIG. 3, FIG. 4, and FIGS. 7 to 9. Each of the plug terminals 3 comprises an embedded end 333 formed at the other end of the second contact portion 33 and embedded by the plug bottom wall 11. In addition, each of the plug terminals 3 comprises a curved segment 313 connected between the first contact portion 31 and the first soldering portion 36, and the embedded end 333 is extended toward the curved segment 313 and adjacent to the curved segment 313. The width of the portion of the first contact portion 31 having the first recessed portion 311 is less than the width of the curved segment 313. The width of the portion of the second contact portion 33 having the second recessed portion 331 is less than the width of the curved segment 313. Since the embedded ends 333 of the plug terminals 3 are secured in the plug bottom wall 11, the plug terminals 3 would not detach from the plug insulated housing 1 easily during insert-molding procedures or when the electrical plug connector 100 is detached from or assembled to an electrical receptacle connector 200. Accordingly, the structural strength of the electrical plug connector 100 can be improved, and the plug terminals 3 can be properly assembled with the plug insulated housing 1.

Figure 10:
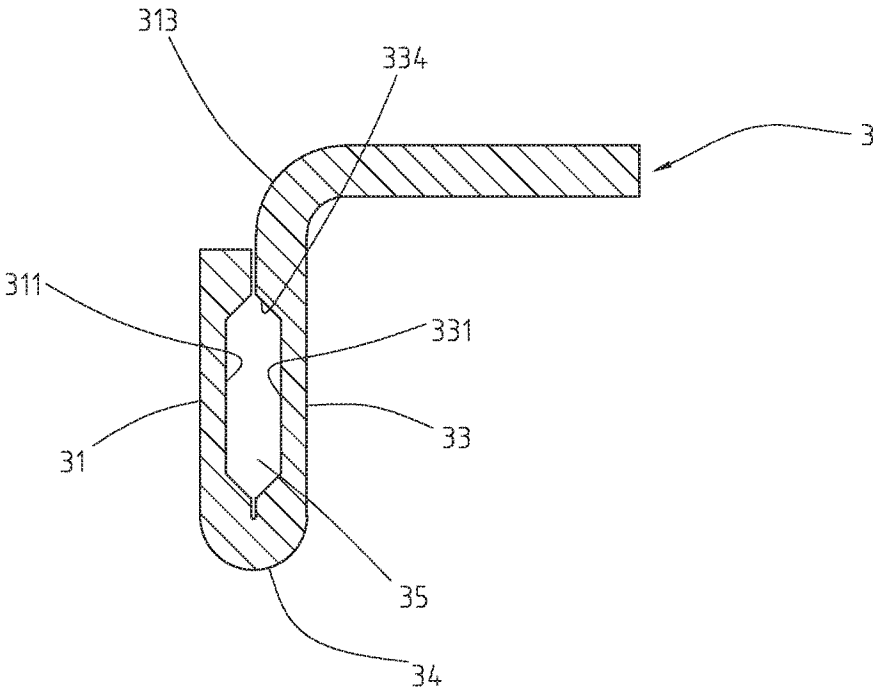
FIG. 10 illustrates a side sectional view of an embodiment of a plug terminal of the electrical plug connector.

Please refer to FIG. 3, FIG. 4 and FIGS. 7 to 9. In this embodiment, the first soldering portion 36 is extended outward from the other end of the first contact portion 31 and protruded from the plug bottom wall 11. Parts of the first soldering portion 36 are processed by laser stripping technologies to produce a nickel barrier area. The nickel barrier area can efficiently stops the solder wicking so as to avoid solder elevation during the SMT procedure. In this embodiment, the first soldering portion 36 may be, but not limited to, extended outward from the other end of the first contact portion 31 along a direction from the first contact portion 31 to the second contact portion 33. Therefore, in this embodiment, the length of the first soldering portion 36 is longer and the area for soldering with a circuit board is wider, as compared to the embodiment to be introduced. Accordingly, the first soldering portion 36 can be properly assembled with the circuit board. In addition, since the length of the first soldering portion 36 is long enough, the solder can be prevented from continuously flowing toward the first contact portion 31 along the first soldering portion 36 (i.e., the solder wicking, which would possibly lead the solder soldered between the first solder portion 36 and the circuit board to be detached easily) when the first soldering portion 36 is soldered with the circuit board. In one embodiment, as shown in FIG. 10, the first soldering portion 36 is extended outward from the other end of the second contact portion 33 along a direction from the first contact portion 31 to the second contact portion 33. In this embodiment, while the length of the first soldering portion 36 is shorter as compared to the foregoing embodiment, the length of the first soldering portion 36 is still long enough to allow the first soldering portion 36 to be soldered with the circuit board. Accordingly, the first soldering portion 36 can be properly assembled with the circuit board. In addition, in this embodiment, the width of the electrical plug connector 100 can be efficiently reduced, too.

The electrical plug connector 100 is made by insert molding techniques, in which high-stability and high-strength liquid crystal polymers (LCP) are utilized to enclose parts of the plug terminals 3, and the rest parts of the plug terminals 3, i.e., the contact portions 31, 33, are exposed for mating with the electrical receptacle connector 200. The plug terminals 3 and the plug insulated housing 1 allow the solder and flux for surface mount technology to be isolated out of the liquid crystal polymers.

Please refer to FIG. 3, FIG. 4, FIGS. 6 to 8, and FIG. 11, which illustrate an embodiment of the electrical receptacle connector 200. The electrical receptacle connector 200 comprises a receptacle insulated housing 5, a plurality of receptacle terminals 6, and a plurality of hold down members. The receptacle insulated housing 5 is an elongated member made of plastics. The receptacle insulated housing 5 comprises a receptacle bottom wall 51, a pair of second sidewalls 53, and a pair of second end walls 55. The pair of second sidewalls 53 is configured to the receptacle bottom wall 51 along the longitudinal direction X, and the pair of second end walls 55 is configured to the receptacle bottom wall 51 along the transversal direction Y. The pair of second sidewalls 53 and the pair of second end walls 55 define a second connecting space 57. When the electrical plug connector 100 is mated with the electrical receptacle connector 200, the pair of first sidewalls 13 is inserted into and received in the second connecting space 57.

Please refer to FIGS. 1 to 3. The receptacle bottom wall 51 of the electrical receptacle connector 200 comprises a tongue portion 511 extended toward the second connecting space 57. Inner walls of the pair of second sidewalls 53 and two sides of the tongue portion 511 have a plurality of terminal grooves 531 respectively arranged along the longitudinal direction X. The terminal grooves 531 are defined through the receptacle bottom wall 51 and communicates with the second connecting space 57. The pair of second sidewalls 53 comprises a plurality of fixing grooves 533. The fixing grooves 533 are defined through the respective second sidewalls 53 and correspond to the respective terminal grooves 531.

Figure 11:
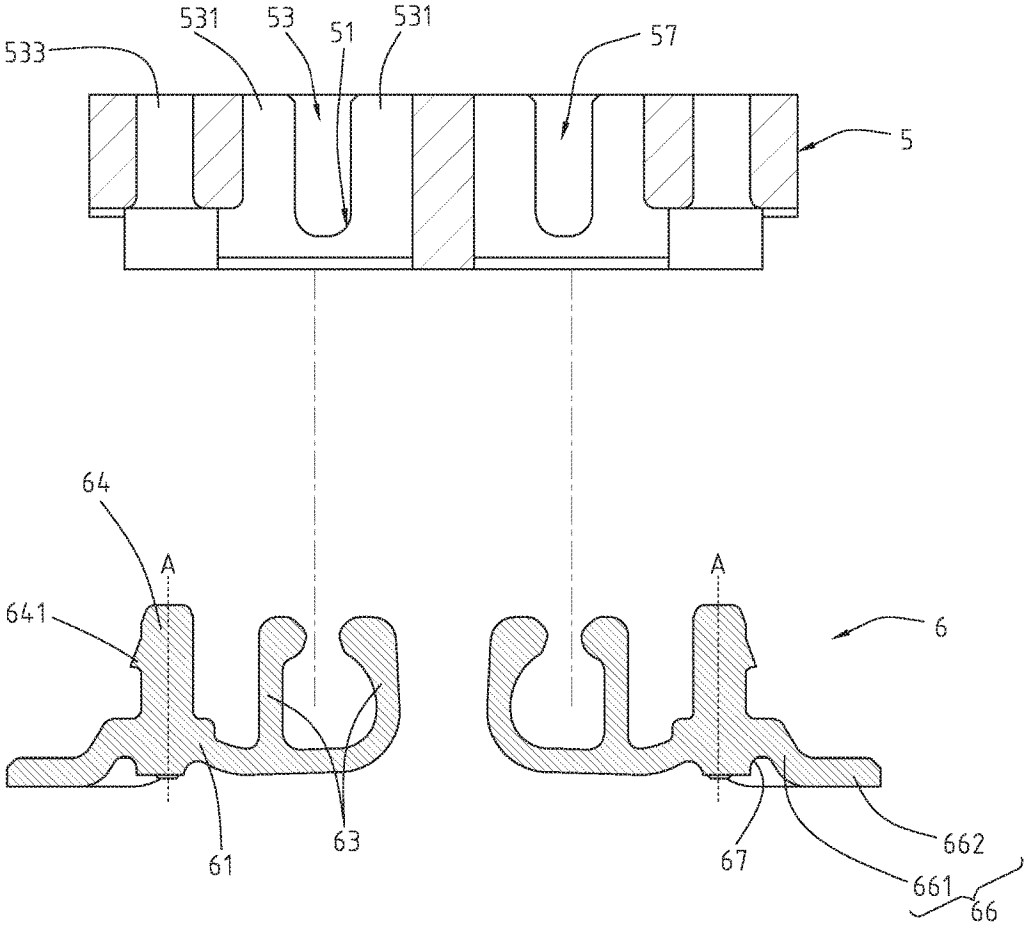
FIG. 11 illustrates a side sectional exploded view of an electrical receptacle connector of the electrical connector assembly.

Please refer to FIG. 3 and FIG. 11. The receptacle terminals 6 are located at the receptacle insulated housing 5 and arranged into two parallel lines. Each of the receptacle terminals 6 comprises a main arm 61, a pair of flexible arms 63, a fixing arm 64, and a second soldering portion 66. In one embodiment, the receptacle terminals 6 are blanking type terminals. Spot plating techniques are applied to the receptacle terminals 6, and the wipe length of the receptacle terminal 6 is longer than that of a forming type terminal. Since the receptacle terminals 6 of the embodiment have longer wipe lengths, dusts and oxidized layers on the surface of the receptacle terminals 6 can be eliminated efficiently.

Please refer to FIG. 3, FIG. 4, and FIGS. 7 to 11. The main arm 61 is disposed below the receptacle bottom wall 51, and the length direction of the main arm 61 is aligned with the width direction of the receptacle bottom wall 51. The pair of flexible arms 63 is outward extended from two ends of the main arm 61 toward the corresponding terminal groove 531. The pair of flexible arms 63 is a floating structure. That is, when the electrical receptacle connector 200 is mated with the electrical plug connector 100, the pair of flexible arms 63 swings with the fixing arm 64 as the center. In this embodiment, the end portions of the pair of flexible arm 63 may be ball shaped. Therefore, the transition segments 34 of the plug terminals 3 can be smoothly guided by the ball-shaped end portions of the flexible arms 63 when the electrical plug connector 100 is mated with the electrical receptacle connector 200. In addition, when the electrical plug connector 100 is mated with the electrical receptacle connector 200, since the end portions of each of the flexible arms 63 are flexible and in contact with the corresponding plug terminal 3, the receptacle terminals 6 can be stably and properly mated with the plug terminals 3, and the electrical receptacle connector 200 would not detach from the electrical plug connector 100 easily.

Please refer to FIG. 3, FIG. 4, and FIGS. 7 to 11. The fixing arm 64 is outward extended from the other end of the main arm 61 into the corresponding fixing groove 533. The fixing arm 64, the pair of flexible arms 63, and the main arm 61 are formed as a laid E-profile. In this embodiment, each of the receptacle terminals 6 further comprises an engaging block 641 protruded from a side portion of the fixing arm 64 and engaged in an inner lateral surface of the corresponding fixing groove 533. Based on this, the receptacle terminals 6 can be properly positioned on the receptacle insulated housing 5. In other words, the engaging block 641 allows the receptacle terminal 6 to be assembled with the receptacle insulated housing 5 stably. Accordingly, when the electrical plug connector 100 is mated with the electrical receptacle connector 200, the engaging block 641 is provided as a fulcrum to allow the pair of flexible arms 63 perform slight deflection, and the pair of flexible arms 63 of each of the receptacle terminals 6 is mated with the corresponding plug terminal 3 in a dual contact manner. Therefore, the electrical receptacle connector 200 and the electrical plug connector 100 can be stably mated with each other.

Please refer to FIG. 3, FIG. 4, and FIGS. 7 to 11. The second soldering portion 66 comprises a bending portion 661 and a contact leg 662. The bending portion 661 is connected between the main arm 61 and the contact leg 662. In other words, the contact leg 662 is extended from the other end of the main arm 61 through the bending portion 661. The contact leg 662 is adapted to connect to a circuit board. The bending portion 661 is extended outward and downward from the main arm 61. A space is defined between the main arm 61 and the circuit board when the contact leg 662 is connected to the circuit board. That is, the bottom surface of the main arm 61 is higher than the bottom surface of the contact leg 662. Therefore, when the receptacle terminal 6 is soldered on the circuit board and the contact leg 662 is in contact with the circuit board, a space is formed between the circuit board and the main arm 61 of the receptacle terminal 6 for air convection. In this embodiment, each of the receptacle terminals 5 further comprises a convection groove 67 recessed at the bottom of the main arm 61 to define an air convection area. The convection groove 67, the engaging block 641, and the soldering portion 66 are positioned at a same side of a central axis A of the fixing arm 64. Based on this, the convection grooves 67 facilitate the heat dissipation of the receptacle terminals 6 when the electrical receptacle connector 200 is in use. In addition, in this embodiment, the two c-shaped convection grooves 67 of the receptacle terminal 6 allow the soldering area of the receptacle terminal 6 to increase. Therefore, the fixation between the second soldering portion 66 and the circuit board can be improved, the solder and flux wicking issue can be prevented efficiently, and the overall defect-free rate of the electrical receptacle connector 200 can increase.

Please refer to FIG. 3, FIG. 4, and FIGS. 7 to 11. Each of the hold down members 7 is approximately of L shape. Each of the hold down members 7 comprises an engaging piece 71 and a contact piece 73 which are integrally formed by blanking procedures. The contact piece is extended from one end of the engaging piece 71 and extended out of the receptacle bottom wall 51. In this embodiment, the receptacle insulated housing 5 comprises a plurality of buckling holes 534 respectively defined at the pair of second end walls 55. The buckling holes 534 are defined to pass through the central portion of the second end wall 55. Accordingly, the engaging pieces 71 are engaged into the respective buckling holes 534, so that the hold down members 7 can be properly assembled with the receptacle insulated housing 5 and provide a sufficient peeling force. In addition, the contact pieces 73 are protruded from the receptacle insulated housing 5 and provided for soldering with the circuit board. Therefore, the electrical receptacle connector can be properly assembled with the circuit board.

Based on the above, the transition segment connected between the first contact portion and the second contact portion allows the first contact portion and the second contact portion to be in contact with each other and arranged substantially parallel, so that connectors with reduced width can be manufactured. Accordingly, the electrical plug connector of embodiments of the instant disclosure can be adapted to high precision products, e.g., smart watches. In addition, since the first contact portion and the second contact portion of each of the plug terminals are in contact with each other which reduce the overall width of the connector, and the shaping space between the first recessed portion and the second recessed portion is provided to receive materials for forming the plug insulated housing, the structural strength of the connector can be improved. When the electrical plug connector is mated with the electrical receptacle connector, the plug terminals would not deform easily, and the deformation of the connector caused by heat can be reduced. Moreover, the embedded ends are provided to allow the plug terminals to be secured with the plug bottom wall, the plug terminals would not detach from the plug insulated housing easily during insert-molding procedures or when the electrical plug connector is detached from or assembled to an electrical receptacle connector. Accordingly, the structural strength of the electrical plug connector can be improved, and the plug terminals can be properly assembled with the plug insulated housing.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector assembly, comprising:

an electrical receptacle connector, comprising:

a receptacle insulated housing comprising a receptacle bottom wall, a pair of second sidewalls, and a pair of second end walls, wherein the pair of second sidewalls is configured to the receptacle bottom wall along a longitudinal direction, the pair of second end walls is configured to the receptacle bottom wall along a transversal direction, the pair of second sidewalls and the pair of second end walls define a second connecting space, the receptacle bottom wall comprises a tongue portion extended toward the second connecting space, inner walls of the pair of second sidewalls and two sides of the tongue portion have a plurality of terminal grooves respectively arranged along the longitudinal direction, the terminal grooves are defined through the receptacle bottom wall and communicates with the second connecting space, the pair of second sidewalls comprises a plurality of fixing grooves, the fixing grooves are defined through the respective second sidewalls and correspond to the respective terminal grooves, a plurality of buckling holes respectively defined at the pair of second end walls, and the buckling holes are defined to pass through the central portion of the second end wall;

a plurality of receptacle terminals, each comprising:

a main arm disposed in the receptacle bottom wall;

a pair of flexible arms outward extended from one of two ends of the main arm toward the corresponding terminal groove, wherein end portions of the pair of flexible arms is ball shaped;

a fixing arm outward extended from the other end of the main arm into the corresponding fixing groove;

a second soldering portion comprising a bent portion and a contact leg, wherein the bent portion is extended outward and downward from the other end of the main arm and further extended toward the contact leg, wherein the bottom surface of the main arm is higher than the bottom surface of the contact leg; and a convection groove near to the bent portion and recessed at the bottom of the main arm to define an air convection area, wherein the convection groove and the soldering portion is positioned at a same side of a central axis of the fixing arm; and a plurality of hold down members, each comprising an engaging piece and a contact piece, wherein the engaging piece is engaged with the corresponding buckling hole, the contact piece is extended from one end of the corresponding engaging piece and extended out of the receptacle bottom wall; and an electrical plug connector, comprising:

a plug insulated housing comprising a plug bottom wall, a pair of first sidewalls, and a pair of first end walls, wherein the pair of first sidewalls is configured to the plug bottom wall along a longitudinal direction, the pair of first end walls is configured to the plug bottom wall along a transversal direction, the pair of first sidewalls and the pair of first end walls define a first connecting space; and a plurality of plug terminals, each comprising:

a first contact portion located in the first connecting space and abutted against one of two surfaces of the corresponding first sidewall, wherein a first recessed portion is formed at the inner lateral surface of the first contact portion, the width of the portion of the first contact portion having the first recessed portion is less than the width of rest of the first contact portion;

a second contact portion located at the other surface of the corresponding first sidewall and aligned parallel to the first contact portion, wherein one of two ends of the second contact portion is extended to one of two ends of the first contact portion through a transition segment, a second recessed portion is formed at the inner lateral surface of the second contact portion, the width of the portion of the second contact portion having the second recessed portion is less than the width of rest of the second contact portion, a shaping space is defined between the first recessed portion and the second recessed portion; and a first soldering portion, extended outward from the other end of the first contact portion and protruded from the plug bottom wall.

* * * * *